US012540440B2

(12) United States Patent
Hjelt et al.

(10) Patent No.: US 12,540,440 B2
(45) Date of Patent: Feb. 3, 2026

(54) PAPER OR PAPERBOARD COATED WITH A FOAM COATING LAYER COMPRISING NANOCELLULOSE

(71) Applicant: Stora Enso OYJ, Helsinki (FI)

(72) Inventors: Tuomo Hjelt, Helsinki (FI); Christiane Laine, Espoo (FI)

(73) Assignee: Stora Enso OYJ, Helsinki (FI)

( * ) Notice: Subject to any disclaimer, the term of this patent is extended or adjusted under 35 U.S.C. 154(b) by 525 days.

(21) Appl. No.: 17/756,982

(22) PCT Filed: Dec. 15, 2020

(86) PCT No.: PCT/IB2020/061951
§ 371 (c)(1),
(2) Date: Jun. 7, 2022

(87) PCT Pub. No.: WO2021/124091
PCT Pub. Date: Jun. 24, 2021

(65) Prior Publication Data

US 2023/0023213 A1 Jan. 26, 2023

(30) Foreign Application Priority Data

Dec. 18, 2019 (SE) ..... 1951497-5

(51) Int. Cl.
*D21H 21/56* (2006.01)
*B65D 65/42* (2006.01)
(Continued)

(52) U.S. Cl.
CPC ..... *D21H 21/56* (2013.01); *B65D 65/42* (2013.01); *D21H 19/42* (2013.01); *D21H 19/52* (2013.01)

(58) Field of Classification Search
CPC ..... B65D 65/42; D21H 19/42; D21H 19/52; D21H 21/56
See application file for complete search history.

(56) References Cited

U.S. PATENT DOCUMENTS 4,184,914 A 1/1980 Jenkins
2012/0167477 A1* 7/2012 Wang ..... B24D 3/00 51/299

(Continued)

FOREIGN PATENT DOCUMENTS

CN 1764612 A * 4/2006 ..... B32B 13/08
WO 2011056130 A1 5/2011

(Continued)

OTHER PUBLICATIONS

International Search Report from corresponding PCT application No. PCT/IB2020/061951 mailed on Mar. 1, 2021.

(Continued)

*Primary Examiner* — Maria V Ewald
*Assistant Examiner* — Ethan Weydemeyer
(74) *Attorney, Agent, or Firm* — Greer, Burns & Crain, Ltd.

(57) ABSTRACT

The present invention relates to coated paper or paperboard comprising: a paper or paperboard substrate, and a solid closed cell foam coating layer disposed on a surface of said a paper or paperboard substrate, wherein said solid closed cell foam coating layer comprises a nanocellulose, and a foaming agent. The invention further relates to a food container, preferably a cup, comprising such coated paper or paperboard.

18 Claims, 2 Drawing Sheets

(51) Int. Cl.
*D21H 19/42* (2006.01)
*D21H 19/52* (2006.01)

(56) References Cited

U.S. PATENT DOCUMENTS

| | | | |
|---|---|---|---|
| 2017/0335522 | A1 | 11/2017 | Heiskanen et al. |
| 2018/0208732 | A1 | 7/2018 | Oomori |
| 2018/0355557 | A1 | 12/2018 | Heiskanen et al. |
| 2019/0226144 | A1 | 7/2019 | Backfolk et al. |

FOREIGN PATENT DOCUMENTS

| | | | |
|---|---|---|---|
| WO | 2014011112 | A1 | 1/2014 |
| WO | 2015092146 | A1 | 6/2015 |
| WO | 2016185398 | A1 | 11/2016 |
| WO | 2018011667 | A1 | 1/2018 |
| WO | 2018171913 | A1 | 9/2018 |
| WO | 2018171914 | A1 | 9/2018 |
| WO | 2020230035 | A1 | 11/2020 |

OTHER PUBLICATIONS

Chinga-Carrasco, Gary, Cellulose fibres, nanofibrils and microfibrils: The morphological sequence of MFC components from a plant physiology and fibre technology point of view, Chinga-Carrasco Nanoscale Research Letters 2011, 6:417.

Fengel, D., Ultrastructural behaviour of cell wall polysaccharides, TAPPI, 1970, vol. 53, No. 3., pp. 497-503 (abstract only).

Extended European Search Report from corresponding European application No. EP2090287.9, dated Dec. 13, 2023.

* cited by examiner

PAPER OR PAPERBOARD COATED WITH A FOAM COATING LAYER COMPRISING NANOCELLULOSE

This application is a U.S. National Phase under 35 U.S.C. § 371 of International Application No. PCT/IB2020/061951, filed Dec. 15, 2020, which claims priority under 35 U.S.C. §§ 119 and 365 to Swedish Application No. 1951497-5 filed Dec. 18, 2019.

TECHNICAL FIELD

The present disclosure relates to thermal insulation layers for paper and paperboard-based packaging materials.

BACKGROUND

Packaging materials based on synthetic polymers, e.g. Styrofoam, are increasingly being replaced by cellulose-based packaging materials. Using cellulose-based packaging materials such as paper or paperboard instead of fossil-based synthetic polymers can reduce the carbon dioxide footprint and improve the recyclability of the packaging materials.

However, paper and paperboard typically provide poor thermal insulation compared to foamed thermoplastics. This is a problem in food containers for hot or cold foods or drinks, where the container may either become too hot for the consumer to handle it safely, or where the consumer may inadvertently heat up cold contents through the walls of the container.

Many solutions have been proposed in order to solve this problem. The most common solution involves providing the container with an additional layer or an insulating sleeve of insulating material, e.g. of corrugated paper or paperboard. However, this type of solution adds complexity to both manufacturing and handling of the products. Another common approach has been to provide the surface of the paper or paperboard with a porous material. However, as the porous materials are typically based on synthetic polymers, this approach may counteract the purpose of replacing synthetic materials with renewable bio-based materials to reduce the carbon dioxide footprint and improve the recyclability of the packaging material.

Thus, there remains a need for solutions for improving the thermal insulation of paper and paperboard-based packaging materials, while still retaining their recyclability.

DESCRIPTION OF THE INVENTION

It is an object of the present disclosure to provide an alternative to the prior art solutions for improving the thermal insulation of paper and paperboard-based packaging materials.

It is a further object of the present disclosure to provide a thermal insulation layer for a paper or paperboard-based packaging material which is based at least partially on renewable raw materials.

The above-mentioned objects, as well as other objects as will be realized by the skilled person in the light of the present disclosure, are achieved by the various aspects of the present disclosure.

According to a first aspect illustrated herein, there is provided a coated paper or paperboard comprising:

a paper or paperboard substrate, and a solid closed cell foam coating layer disposed on a surface of said a paper or paperboard substrate, wherein said solid closed cell foam coating layer comprises a nanocellulose, and a foaming agent.

The term foam, as used herein, refers to a substance made by trapping air or gas bubbles inside a solid or liquid. Typically, the volume of gas is much larger than that of the liquid or solid, with thin films separating gas pockets. Three requirements must be met in order for foam to form. Mechanical work is needed to increase the surface area. This can occur by agitation, dispersing a large volume of gas into a liquid, or injecting a gas into a liquid. The second requirement is that a foam forming agent, typically an amphiphilic substance, a surfactant or surface active component, must be present to decrease surface tension. Finally, the foam must form more quickly than it breaks down. Foams can be liquid or solid. Examples of liquid foams include shaving cream, fire retardant foam, and soap bubbles. Examples of solid foams include polystyrene and polyurethane foams.

The term solid, as used herein, refers to a material that is not liquid or fluid, but firm and stable in shape. A solid is a sample of matter that retains its shape and density when not confined. The solid may be rigid, or susceptible to plastic and/or elastic deformation. The adjective solid describes the state, or condition, of matter having this property. A solid material may be porous or non-porous. Accordingly, the term solid foam as used herein refers to a foam in solid form.

Solid foams may be open-cell or closed-cell in nature. Pores connect the gas regions in open-cell foams, while closed-cell foams have enclosed cells. The solid closed cell foam coating layer described herein comprise closed cells, or a combination of closed and open cells. The cells are usually disordered in their arrangement, with varying cell sizes (see FIG. 2). The cells may present minimal surface area and may form honeycomb shapes or tessellations.

The invention is based on the surprising realization that nanocellulose together with a foaming agent can be used to prepare a solid closed cell foam with significant thermal insulating properties. The solid closed cell foam comprises closed cells, e.g. pores or bubbles, trapped inside a matrix formed of the nanocellulose, foaming agent and optional other additives. The closed cell structure together with the low air permeability of the nanocellulose matrix provides for excellent thermal insulating properties.

The coated paper or paperboard can be prepared by preparing an aqueous mixture of a nanocellulose and a foaming agent, foaming said mixture to obtain a foam, coating a surface of a paper or paperboard substrate with the foam and drying the coated substrate to obtain a solid closed cell foam coated paper or paperboard.

The solid closed cell foam coating can be applied directly on the paper or paperboard surface or on top of an intermediate layer or coating provided on the paper or paperboard substrate.

Paper generally refers to a material manufactured in thin sheets from the pulp of wood or other fibrous substances comprising cellulose fibers, used for e.g. writing, drawing, or printing on, or as packaging material.

Paperboard generally refers to strong, thick paper or cardboard comprising cellulose fibers used for e.g. boxes and other types of packaging. Paperboard can either be bleached or unbleached, coated or uncoated, and produced in a variety of thicknesses, depending on the end use requirements.

Nanocellulose comprises partly or totally fibrillated cellulose or lignocellulose fibers. The liberated fibrils have a diameter less than 1000 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril, is the main product that is obtained when making MFC e.g. by using an extended refining process or pressure-drop disintegration process (Fengel, D., *Ultrastructural behavior of cell wall polysaccharides, Tappi J.*, March 1970, Vol 53, No. 3). Depending on the source and the manufacturing process, the length of the fibrils can vary from around 1 to more than 10 micrometers. A coarse nanocellulose grade might contain a substantial fraction of fibrillated fibers, i.e. protruding fibrils from the tracheid (cellulose fiber), and with a certain amount of fibrils liberated from the tracheid (cellulose fiber).

There are different synonyms for nanocellulose such as cellulose microfibrils, fibrillated cellulose, nanofibrillated cellulose (NFC), fibril aggregates, nanoscale cellulose fibrils, cellulose nanofibers, cellulose nanofibrils, nanocrystalline cellulose, cellulose microfibers, cellulose fibrils, cellulose nanofilaments, microfibrillar cellulose, microfibrillated cellulose (MFC), microfibril aggregrates and cellulose microfibril aggregates.

Nanocellulose can also be characterized by various physical or physical-chemical properties such as its large surface area or its ability to form a gel-like material at low solids (1-5 wt %) when dispersed in water. The cellulose fiber is preferably fibrillated to such an extent that the final specific surface area of the formed nanocellulose is from about 1 to about 500 $m^2/g$, such as from about 1 to about 200 $m^2/g$, or more preferably 50-200 $m^2/g$ when determined for a solvent exchanged and freeze-dried material with the BET method.

Various methods exist to make nanocellulose, such as single or multiple pass refining, pre-hydrolysis or enzymatic treatment followed by refining or high shear disintegration or liberation of fibrils. Nanocellulose may also be prepared without refining by high consistency enzyme assisted cellulose fibrillation as described in WO 2015/092146 A1.

One or several pre-treatment steps are usually required in order to make nanocellulose manufacturing both energy efficient and sustainable. The cellulose fibers of the pulp to be utilized may thus be pre-treated, for example enzymatically or chemically, for example to hydrolyse or swell the fibers or to reduce the quantity of hemicellulose or lignin. The cellulose fibers may be chemically modified before fibrillation, such that the cellulose molecules contain other (or more) functional groups than found in the original or native cellulose. Such groups include, among others, carboxymethyl (CM), aldehyde and/or carboxyl groups (cellulose obtained by N-oxyl mediated oxidation, for example "TEMPO"), quaternary ammonium (cationic cellulose) or phosphoryl groups. After being modified or oxidized in one of the above-described methods, it is easier to disintegrate the fibers into nanocellulose or nanofibrillar size fibrils.

The nanocellulose may contain some hemicelluloses, the amount of which is dependent on the plant source. Mechanical disintegration of the fibers is carried out with suitable equipment such as a refiner, grinder, homogenizer, collider, friction grinder, single- or twin-screw extruder, ultrasound sonicator, fluidizer such as microfluidizer, macrofluidizer or fluidizer-type homogenizer. Depending on the nanocellulose manufacturing method, the product might also contain fines, or nanocrystalline cellulose, or other chemicals present in wood fibers or in the papermaking process. The product might also contain various amounts of micron size fiber particles that have not been efficiently fibrillated.

Nanocellulose can be produced from wood cellulose fibers, both from hardwood and softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper. The term nanocellulose includes parenchymal nanocellulose and BNC (bacterial nanocellulose). Nanocellulose can also be obtained from vegetable fibers, e.g. sugar beet or potato based nanocellulose.

The above described definition of nanocellulose includes, but is not limited to, the definition of nanocellulose in the ISO/TS 20477:2017 standard.

The nanocellulose of the closed cell foam coating layer may be unmodified nanocellulose or chemically modified nanocellulose, or a mixture thereof. In some embodiments, the nanocellulose is an unmodified nanocellulose.

Unmodified nanocellulose refers to nanocellulose made of unmodified or native cellulose fibers. The unmodified nanocellulose may be a single type of nanocellulose, or it can comprise a mixture of two or more types of nanocellulose, differing e.g. in the choice of cellulose raw material or manufacturing method.

Chemically modified nanocellulose refers to nanocellulose made of cellulose fibers that have undergone chemical modification before, during or after fibrillation. In some embodiments, the nanocellulose is a chemically modified nanocellulose. The chemically modified nanocellulose may be a single type of chemically modified nanocellulose, or it can comprise a mixture of two or more types of chemically modified nanocellulose, differing e.g. in the type of chemical modification, the choice of cellulose raw material or the manufacturing method. In some embodiments, the chemically modified nanocellulose is microfibrillated dialdehyde cellulose (DA-MFC). DA-MFC is a dialdehyde cellulose treated in such way that it is microfibrillated. Dialdehyde cellulose can be obtained by oxidation of cellulose. Microfibrillated dialdehyde cellulose can be obtained by treating dialdehyde cellulose for example by a homogenizer or in any other way such that fibrillation occurs to produce microfibrillated dialdehyde cellulose. In some embodiments, the nanocellulose of the of the closed cell foam coating layer comprises 0-80 wt % DA-MFC, the remainder being unmodified nanocellulose.

The closed cell foam coating layer may be comprised solely of a mixture of nanocellulose and foaming agent, or it can comprise the mixture of nanocellulose and foaming agent combined with other ingredients or additives. The closed cell foam coating layer preferably includes nanocellulose as its main component based on the total dry weight of the closed cell foam coating layer. In some embodiments, the closed cell foam of the coating layer comprises in the range of 50-99.5 wt %, preferably in the range of 60-99.5 wt %, more preferably in the range of 65-98 wt % of nanocellulose, based on the total dry weight of the closed cell foam.

The foaming agent of the closed cell foam coating layer may be any foaming agent suitable for facilitating the formation of a foam in an aqueous nanocellulose dispersion and for stabilizing the formed foam. The foaming agent is generally a surfactant. A surfactant reduces the work needed to create the foam by reducing the surface tension of the liquid and increases the colloidal stability of the foam by inhibiting coalescence of bubbles.

In some embodiments, the foaming agent is a non-ionic surfactant.

Certain polymeric foaming agents have been found to be particularly useful for forming the closed cell foam of the closed cell foam coating layer. In addition to acting as foaming agents, the polymeric foaming agents may also act as polymeric dispersing and/or rheology modifying agents. Using a polymeric foaming agent may thus further improve the foam formation and the stability of the formed aqueous foam. The use of a polymeric foaming agent may therefore reduce or completely dispense with addition of an optional additional polymeric dispersing and/or rheology modifying agent. A polymeric foaming agent may also improve the stability and mechanical properties of the solid closed cell foam coating layer formed when the water of the aqueous foam has evaporated. Thus, in some preferred embodiments the foaming agent is a polymeric foaming agent.

In some embodiments, the foaming agent is selected from the group consisting of optionally hydrophobically modified polysaccharide ethers, starch, hemicellulose derivatives and polyvinyl alcohol, and mixtures thereof, preferably a polysaccharide ether, and more preferably a cellulose ether. The optional hydrophobic modification typically comprises one or more hydrophobic groups, e.g. alkyl groups, covalently attached to the foaming agent.

In some embodiments, the foaming agent is an optionally hydrophobically modified polysaccharide ether selected from the group consisting of optionally hydrophobically modified methyl cellulose (MC), ethyl cellulose (EC), hydroxyethyl cellulose (HEC), hydroxypropyl cellulose (HPC), methylethyl cellulose (MEC), hydroxyethylmethyl cellulose (HEMC), hydroxypropylmethyl cellulose (HPMC), ethylhydroxyethyl cellulose, carboxymethylhydroxyethyl cellulose, and mixtures thereof.

In some embodiments, the foaming agent is methyl cellulose.

In some embodiments, the methyl cellulose has an average degree of substitution in the range of 1.0-2.5, preferably in the range of 1.5-1.9.

In some embodiments, the foaming agent has a viscosity in aqueous solution at 2 wt % concentration between 10 and 10,000 cPs. The viscosity values specified herein refer to Brookfield viscosity measured according to SCAN-P 50:84 unless otherwise specified.

In some embodiments, the foaming agent is low molecular weight methyl cellulose having a viscosity in aqueous solution at 2 wt % concentration between 10 and 100 cPs, preferably between 10 and 50 cPs.

In some embodiments, the foaming agent is high molecular weight methyl cellulose having a viscosity in aqueous solution at 2 wt % concentration between 100 and 10,000 cPs, preferably between 1000 and 7000 cPs.

In some embodiments, the closed cell foam of the closed cell foam coating layer comprises in the range of 0.1-10 wt %, preferably in the range of 0.5-6 wt %, more preferably in the range of 2-6 wt % of foaming agent, based on the total dry weight of the closed cell foam.

The foaming agent may optionally be combined with one or more polymeric dispersing and/or rheology modifying agents. The inventors have found that the addition of a polymeric dispersing and/or rheology modifying agent can further improve the foam formation and the stability of the formed aqueous foam. A polymeric dispersing and/or rheology modifying agent may also improve the stability and mechanical properties of the solid closed cell foam coating layer formed when the water of the aqueous foam has evaporated.

A polymeric dispersing and/or rheology modifying agent may be especially useful when the foaming agent is not a polymeric foaming agent. However, a polymeric dispersing and/or rheology modifying agent may also be useful when the foaming agent is a polymeric foaming agent, but additional modification of the foam properties is desired. The polymeric dispersing and/or rheology modifying agent may be a dispersing agent, a rheology modifying agent or a combination of both.

Examples of dispersing agents useful in the solid closed cell foam coating layer include, but are not limited to, polycarboxylates such as polyacrylates or carboxylated polysaccharides, and polyphosphates.

Examples of rheology modifying agents useful in the solid closed cell foam coating layer include, but are not limited to, cellulosic polymers, starch, alginate, proteins, polyacrylates and other acrylic polymers and ethoxylated polyurethanes.

Examples of polymeric dispersing and/or rheology modifying agents useful in the solid closed cell foam coating layer include, but are not limited to, polycarboxylates such as polyacrylates or carboxylated polysaccharides.

In some embodiments, the polymeric dispersing and/or rheology modifying agent is a carboxymethyl cellulose (CMC).

The concentration of the polymeric dispersing and/or rheology modifying agent is suitably selected depending on the type and molecular weight of the polymer. In some embodiments, the closed cell foam of the coating layer comprises in the range of 0.1-20 wt %, preferably in the range of 0.3-10 wt %, more preferably in the range of 0.5-5 wt % of the polymeric dispersing and/or rheology modifying agent, based on the total dry weight of the closed cell foam.

In some more specific embodiments, the closed cell foam of the coating layer comprises in the range of 50-99.5 wt %, preferably in the range of 60-99.5 wt %, more preferably in the range of 65-98 wt % of nanocellulose, based on the total dry weight of the closed cell foam, and in the range of 0.1-10 wt %, preferably in the range of 0.5-6 wt %, more preferably in the range of 2-6 wt % of polymeric foaming agent, based on the total dry weight of the closed cell foam, and in the range of 0.1-20 wt %, preferably in the range of 0.3-10 wt %, more preferably in the range of 0.5-5 wt % of the polymeric dispersing and/or rheology modifying agent, based on the total dry weight of the closed cell foam.

The formulation of the closed cell foam coating layer may vary depending on the intended use and on the other layers present in a finished multilayer packaging material. The formulation of the closed cell foam coating layer may also vary depending on the intended mode of application or formation of the closed cell foam coating layer, e.g. coating of a foamed aqueous mixture of the nanocellulose and foaming agent onto a substrate or formation of a free-standing closed cell foam film for lamination to a substrate. The closed cell foam coating layer may include a wide range of ingredients in varying quantities to improve the end performance of the product or processing of the coating.

The closed cell foam coating layer may further comprise additives such as starch, a filler, retention aids, flocculation additives, deflocculating additives, dry strength additives, softeners, or mixtures thereof. The closed cell foam coating layer may further comprise additives that will improve different properties of the mixture and/or the produced film such as latex and/or polyvinyl alcohol (PVOH) for enhancing the ductility of the coating.

In some embodiments, the closed cell foam coating layer further comprises a polymeric binder. In some preferred embodiments, the closed cell foam coating layer further comprises PVOH. The PVOH may be a single type of PVOH, or it can comprise a mixture of two or more types of PVOH, differing e.g. in degree of hydrolysis or viscosity. The PVOH may for example have a degree of hydrolysis in the range of 80-99 mol %, preferably in the range of 88-99 mol %. Furthermore, the PVOH may preferably have a viscosity above 5 mPa×s in a 4% aqueous solution at 20° C. DIN 53015/JIS K 6726.

In some embodiments, the closed cell foam coating layer further comprises a particulate material dispersed in the closed cell foam coating layer.

In some embodiments, the closed cell foam coating layer further comprises a pigment. The pigment may for example comprise inorganic particles of talcum, silicates, carbonates, alkaline earth metal carbonates and ammonium carbonate, or oxides, such as transition metal oxides and other metal oxides. The pigment may also comprise nano-size pigments such as nanoclays and nanoparticles of layered mineral silicates, for instance selected from the group comprising montmorillonite, bentonite, kaolinite, hectorite and halloysite.

In some embodiments, the pigment is selected from the group consisting of nanoclays and nanoparticles of layered mineral silicates, more preferably bentonite.

The closed cell foam coating layer may further comprise a particulate material having a low thermal conductivity, such as cork, wood, other biomass or Styrofoam. Preferably however, the particulate material is a bio-based material, such as cork, wood or other biomass. In some embodiments the closed cell foam coating layer further comprises a particulate material selected from the group consisting of cork particles and wood particles. In a preferred embodiment the particulate material is cork particles. Cork is a closed-cell biological material with a set of specific properties that result from its chemical composition and cellular structure, i.e. very low permeability, hydrophobic behaviour, biological inertia, large elastic compression and dimensional recovery.

The particulate material preferably has an average particle diameter in the range of 0.1-1000 μm, preferably in the range of 1-1000 μm, more preferably in the range of 1-100 μm.

In some embodiments, the closed cell foam of the closed cell foam coating layer comprises in the range of 1-50 wt %, preferably in the range of 5-45 wt %, more preferably in the range of 10-40 wt % of a particulate material, based on the total dry weight of the closed cell foam.

In some embodiments, the closed cell foam of the coating layer comprises in the range of 50-99.5 wt %, preferably in the range of 60-99.5 wt %, more preferably in the range of 65-98 wt % of nanocellulose, based on the total dry weight of the closed cell foam, and in the range of 1-10 wt %, preferably in the range of 1-5 wt %, more preferably in the range of 2-5 wt % of polymeric foaming agent, based on the total dry weight of the closed cell foam.

In some embodiments, the closed cell foam of the coating layer comprises in the range of 50-99.5 wt %, preferably in the range of 60-99.5 wt %, more preferably in the range of 65-98 wt % of nanocellulose, based on the total dry weight of the closed cell foam, and in the range of 0.1-10 wt %, preferably in the range of 0.5-5 wt %, more preferably in the range of 2-5 wt % of polymeric foaming agent, based on the total dry weight of the closed cell foam, and in the range of 0.1-20 wt %, preferably in the range of 0.3-10 wt %, more preferably in the range of 0.5-5 wt % of the polymeric dispersing and/or rheology modifying agent, based on the total dry weight of the closed cell foam, and wherein the combined amount of the polymeric foaming agent and the polymeric dispersing and/or rheology modifying agent is in the range of 1-20 wt %, preferably in the range of 1-10 wt %, more preferably in the range of 1-5 wt %, more preferably in the range of 2-5 wt %, based on the total dry weight of the closed cell foam.

In some more specific embodiments, the closed cell foam of the coating layer comprises in the range of 50-99.5 wt %, preferably in the range of 60-99.5 wt %, more preferably in the range of 65-98 wt % of nanocellulose, based on the total dry weight of the closed cell foam, and in the range of 0.1-10 wt %, preferably in the range of 0.5-5 wt %, more preferably in the range of 2-5 wt % of polymeric foaming agent, based on the total dry weight of the closed cell foam, and in the range of 0.1-20 wt %, preferably in the range of 0.3-10 wt %, more preferably in the range of 0.5-5 wt % of the polymeric dispersing and/or rheology modifying agent, based on the total dry weight of the closed cell foam, and in the range of 0.1-50 wt %, preferably in the range of 0.3-35 wt %, more preferably in the range of 0.5-20 wt % of cork particles and/or wood particles, based on the total dry weight of the closed cell foam. Preferably the combined amount of the polymeric foaming agent and the polymeric dispersing and/or rheology modifying agent is in the range of 1-20 wt %, preferably in the range of 1-10 wt %, more preferably in the range of 1-5 wt %, more preferably in the range of 2-5 wt %, based on the total dry weight of the closed cell foam.

The basis weight (corresponding to the thickness) of the closed cell foam coating layer is preferably in the range of less than 100 gsm (grams per square meter). The basis weight of the closed cell foam coating layer may for example depend on the mode of its manufacture. For example, foam coating onto a substrate may result in a thinner layer, whereas the formation of a free-standing closed cell foam film for lamination to a substrate may require a thicker layer. In some embodiments, the basis weight of the closed cell foam coating layer is in the range of 5-50 gsm. In some embodiments, the basis weight of the closed cell foam coating layer is in the range of 10-50 gsm, preferably in the range of 18-45 gsm.

The closed cell foam coating layer is typically thick compared to conventional coating layers. The thickness of the closed cell foam coating layer is typically 30 μm or higher, preferably 50 μm or higher. In some embodiments, the thickness of the closed cell foam coating layer is in the range of 30-1000 μm, preferably in the range of 50-500 μm, more preferably in the range of 50-300 μm.

Due to its porous nature, the closed cell foam coating layer typically has a low density. In some embodiments, the density of the closed cell foam coating layer is below 0.7 $g/cm^3$, preferably below 0.5 $g/cm^3$, more preferably below 0.3 $g/cm^3$. In some embodiments, the bulk of the obtained closed cell foam coating layer is above 1.4 $cm^3/g$, preferably above 2 $cm^3/g$, more preferably above 3.3 $cm^3/g$.

In some embodiments, the average diameter of the closed cells in the closed cell foam coating layer is in the range of 5-300 μm. The average diameter of the closed cells in the closed cell foam coating layer is measured by analyzing SEM (scanning electron microscope) pictures of cross-cuts of the material.

In some embodiments, the basis weight of the paper or paperboard substrate is in the range of 20-500 gsm, preferably in the range of 60-500 gsm, more preferably in the range of 80-400 gsm.

In some embodiments, the thermal conductivity of the coated paper or paperboard is below 0.1 W/mK, preferably below 0.08 W/mK. This may be compared to e.g. uncoated paperboard having a thermal conductivity of about 0.12 W/mK, wood (pine) having a thermal conductivity of about 0.12 W/mK, cork having a thermal conductivity of about 0.07 W/mK and Styrofoam having a thermal conductivity of about 0.03 W/mK. The thermal conductivity can be measured using the Transient Plane Source (TPS) method with a Hot Disk Thermal Constants Analyser (Hot Disk Ltd.)

The coated paper or paperboard described herein with reference to the first aspect may advantageously be used in containers, particularly food containers, for holding hot or cold contents.

In some embodiments, the coated paper or paperboard described herein is a part of a multilayer packaging material comprising, in addition to the coated paper or paperboard, one or more additional layers providing mechanical properties, barrier properties, optical properties or aesthetic properties to the multilayer packaging material.

In some embodiments, the coated paper or paperboard is a laminate with the closed cell foam layer arranged between the paper or paperboard substrate and a second paper or paper board layer.

The coated paper or paperboard may further comprise at least one polymer layer as a liquid barrier. The polymer layer may comprise any of the polymers commonly used in paper or paperboard-based packaging materials in general or polymers used in liquid packaging board in particular. Examples include polyethylene (PE), polyethylene terephthalate (PET), polypropylene (PP) and polylactic acid (PLA). Polyethylenes, especially low density polyethylene (LDPE) and high density polyethylene (HDPE), are the most common and versatile polymers used in liquid packaging board.

The polymer layer of the coated paper or paperboard preferably comprises a thermoplastic polymer. In some embodiments, the polymer layer comprises a polyolefin. Thermoplastic polymers, and particularly polyolefins are useful since they can be conveniently processed by extrusion coating techniques to form very thin and homogenous films with good liquid barrier properties. In some embodiments, the polymer layer comprises polypropylene or polyethylene. In preferred embodiments, the polymer layer comprises polyethylene, more preferably LDPE or HDPE.

The basis weight (corresponding to the thickness) of the polymer layer is preferably less than 50 gsm (grams per square meter). In order to achieve a continuous and substantially defect free film, a basis weight of the polymer layer of at least 8 gsm, preferably at least 12 gsm is typically required. In some embodiments, the basis weight of the polymer layer is in the range of 8-50 gsm, preferably in the range of 12-50 gsm.

In some non-limiting embodiments, the coated paper or paperboard has the following general structures:

Paperboard/Foam layer
Paperboard/Foam layer/PE (protective)
Paperboard/Adhesive layer/Foam layer/PE (protective)
PE (protective)/Paperboard/Foam layer
PE (protective)/Paperboard/Foam layer/PE (protective)
PE (protective)/Paperboard/Adhesive layer/Foam layer/PE (protective)

The thickness (basis weight) of the outermost protective PE layers, is selected depending on if the layer is intended to form an outside or inside surface of a container manufactured from the packaging material. For example, an inside surface for a liquid packaging container may require a thicker PE layer to serve as a liquid barrier, whereas the outside surface a thinner PE layer may be sufficient.

The basis weight (corresponding to the thickness) of the protective PE layer is preferably less than 50 gsm (grams per square meter). In order to achieve a continuous and substantially defect free film, a basis weight of the protective PE layer of at least 8 gsm, preferably at least 12 gsm is typically required. In some embodiments, the basis weight of the protective PE layer is in the range of 8-50 gsm, preferably in the range of 12-50 gsm.

According to a second aspect illustrated herein, there is provided a carton blank comprising a coated paper or paperboard as described herein with reference to the first aspect. The carton blank can be used for manufacturing a food container, preferably a cup, for holding hot or cold contents.

The coated paper or paperboard of the carton blank according to the second aspect may be further defined as set out above with reference to the first aspect.

According to a third aspect illustrated herein, there is provided a food container, preferably a cup, comprising a coated paper or paperboard as described herein with reference to the first aspect.

The coated paper or paperboard of the food container according to the third aspect may be further defined as set out above with reference to the first aspect.

According to a fourth aspect illustrated herein, there is provided a method of manufacturing a coated paper or paperboard as described herein with reference to the first aspect, said method comprising the steps:

a) preparing an aqueous mixture of a nanocellulose and a foaming agent,
b) foaming said mixture to obtain a foam,
c) coating a surface of a paper or paperboard substrate with the foam and drying the coated substrate to obtain a solid closed cell foam coated paper or paperboard.

Thus, in the inventive method dried foam structures are created by foam coating of nanocellulose together with a foaming agent and optional other additives.

The foam can be applied directly on the paper or paperboard surface or on top of an intermediate layer or coating provided on the paper or paperboard substrate.

The nanocellulose and the foaming agent in step a) may be further defined as set out above with reference to the first aspect.

In some embodiments, the total solid content of the aqueous mixture prior to foaming is preferably in the range of 1-50 wt %. Formation of a solid closed cell foam coating layer is believed to be favored by a total solid content of the aqueous mixture prior to foaming of 5 wt % or higher. In some embodiments, the total solid content of the aqueous mixture prior to foaming is in the range of 5-50 wt %, preferably in the range of 5-30 wt %, and more preferably in the range of 5-20 wt %. In more preferred embodiments the total solid content of the aqueous mixture prior to foaming is in the range of 7-15 wt %, preferably in the range of 7-12 wt %, and more preferably in the range of 8-12 wt %.

In some embodiments, the aqueous mixture prior to foaming comprises in the range of 50-99.5 wt %, preferably in the range of 60-99.5 wt %, more preferably in the range of 65-98 wt % of nanocellulose, based on the total dry weight of the aqueous mixture.

In some embodiments, the aqueous mixture prior to foaming comprises in the range of 0.1-10 wt %, preferably in the range of 0.5-6 wt %, more preferably in the range of 2-6 wt % of foaming agent, based on the total dry weight of the aqueous mixture.

In some embodiments, the foaming agent is selected from the group consisting of polysaccharide ethers, starch, hemicellulose derivatives and polyvinyl alcohol, and mixtures thereof, preferably a polysaccharide ether, and more preferably a cellulose ether.

In some embodiments, the foaming agent is selected from the group consisting of methyl cellulose (MC), ethyl cellulose (EC), hydroxyethyl cellulose (HEC), hydroxypropyl cellulose (HPC), methylethyl cellulose (MEC), hydroxyethylmethyl cellulose (HEMC), hydroxypropylmethyl cellulose (HPMC), ethylhydroxyethyl cellulose, carboxymethylhydroxyethyl cellulose, and mixtures thereof.

In some embodiments, the foaming agent is methyl cellulose.

The foaming agent may optionally be combined with one or more polymeric dispersing and/or rheology modifying agents. The inventors have found that the addition of a polymeric dispersing and/or rheology modifying agent to the aqueous mixture can further improve the foam formation and the stability of the formed aqueous foam. A polymeric dispersing and/or rheology modifying agent may also improve the stability and mechanical properties of the solid closed cell foam coating layer formed when the water of the aqueous foam has evaporated.

Examples of polymeric dispersing and/or rheology modifying agents useful in the solid closed cell foam coating layer include, but are not limited to, polycarboxylates such as polyacrylates or carboxylated polysaccharides. In some embodiments, the polymeric dispersing and/or rheology modifying agent is a carboxymethyl cellulose (CMC).

The concentration of the polymeric dispersing and/or rheology modifying agent is suitably selected depending on the type and molecular weight of the polymer. In some embodiments, the aqueous mixture comprises in the range of 0.1-20 wt %, preferably in the range of 0.3-10 wt %, more preferably in the range of 0.5-5 wt % of the polymeric dispersing and/or rheology modifying agent, based on the total dry weight of the aqueous mixture.

In some embodiments the polymeric dispersing and/or rheology modifying agent is shear thinning in the aqueous mixture.

The dissolved polymeric components of the aqueous mixture, particularly a polymeric foaming agent and/or a polymeric dispersing and/or rheology modifying agent make the aqueous mixture viscous. Formation of a solid closed cell foam coating layer is believed to be favored by the higher viscosity.

The viscosity of the aqueous mixture is related to the total content of dissolved polymer in the aqueous mixture. In some embodiments, the total content of dissolved polymer in the aqueous mixture prior to foaming is 0.3 wt % or higher, preferably 0.5 wt % or higher based on weight of water in the aqueous mixture. In some embodiments, the total content of dissolved polymer in the aqueous mixture prior to foaming is in the range of 0.3-10 wt %, preferably in the range of 0.5-5 wt % based on weight of water in the aqueous mixture.

In some embodiments, the aqueous mixture prior to foaming is shear thinning.

In some embodiments, the foaming in step b) is achieved by high speed mixing.

In some embodiments a particulate material is dispersed in the foam. The particulate material may for example be a particulate material having a low thermal conductivity, such as cork, wood, other biomass or Styrofoam. Preferably however, the particulate material is a bio-based material, such as cork, wood or other biomass. In some embodiments the particulate material is selected from the group consisting of cork particles and wood particles. In a preferred embodiment the particulate material is cork particles. Cork is a closed-cell biological material with a set of specific properties that result from its chemical composition and cellular structure, i.e. very low permeability, hydrophobic behaviour, biological inertia, large elastic compression and dimensional recovery.

The particulate material preferably has an average particle diameter in the range of 0.1-1000 μm, preferably in the range of 1-1000 μm, more preferably in the range of 1-100 μm.

In some embodiments, the foam comprises in the range of 1-50 wt %, preferably in the range of 5-45 wt %, more preferably in the range of 10-40 wt % of a particulate material, based on the total dry weight of the closed cell foam.

In some embodiments, the drying in step c) is performed at a temperature above 50° C., preferably above 70° C., more preferably above 90° C. In some embodiments, the drying in step c) is performed at a temperature above 100° C.

The obtained closed cell foam coating layer is typically thick compared to conventional coating layers. The thickness of the obtained closed cell foam coating layer is typically 30 μm or higher, preferably 50 μm or higher. In some embodiments, the thickness of the obtained closed cell foam coating layer is in the range of 30-1000 μm, preferably in the range of 50-500 μm, more preferably in the range of 50-300 μm.

Due to its porous nature with air enclosed in closed pores, the obtained closed cell foam coating layer typically has a low density. In some embodiments, the density of the obtained closed cell foam coating layer is below 0.7 g/cm$^3$, preferably below 0.5 g/cm$^3$, more preferably below 0.3 g/cm$^3$. In some embodiments, the bulk of the obtained closed cell foam coating layer is above 1.4 cm$^3$/g, preferably above 2 cm$^3$/g, more preferably above 3.3 cm$^3$/g.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

EXAMPLES

TABLE 1

Figure 1:
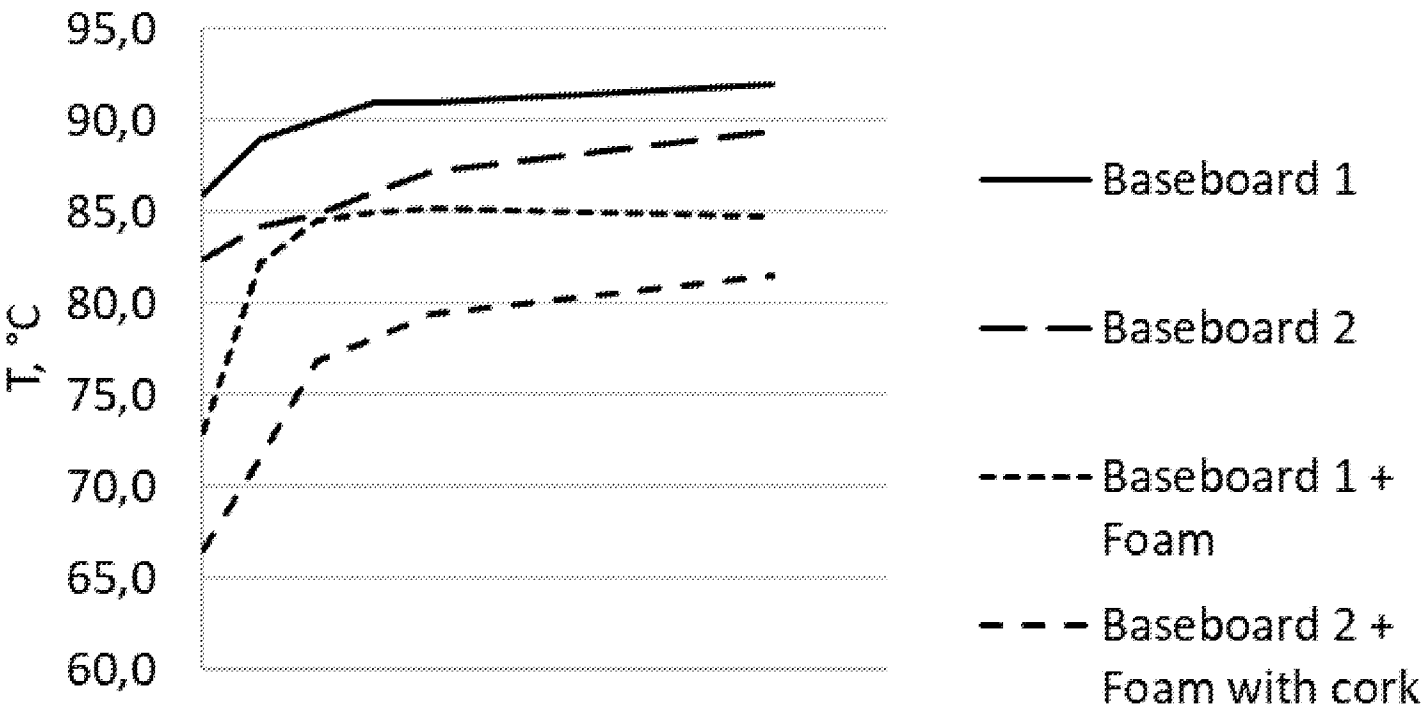
FIG. 1 is a diagram comparing the thermal resistance of baseboard 1, baseboard 2, baseboard 1 with foam coating, and baseboard 2 with foam coating with cork dust.

| Materials: | | | |
|---|---|---|---|
| Material | Description | Producer | Solids content (wt %) |
| Baseboard 1 | Paperboard, grammage = 249 gsm, thickness = 309 μm | | 100 |
| Baseboard 2 | Paperboard, grammage = 214 gsm, thickness = 330 μm | | 100 |
| HefCel | High solids content nanocellulose prepared from softwood pulp by high consistency enzyme assisted cellulose fibrillation as described in WO 2015/092146 A1. | VTT | 19.8 |
| Carboxymethyl cellulose (CMC) | Finnfix 30 000, dispersing agent and rheology modifier | CPKelco | 0.8/2.1 |
| Methyl cellulose, high molecular weight[1] (MeC hiMw) | M0512, foaming polymer and rheology modifier, viscosity 4000 cPs at 2% | Sigma | 0.84 |
| Methyl cellulose, low molecular weight[1] (MeC loMw) | M6385, foaming polymer, viscosity 25 cPs at 2% | Sigma | 2.9 |
| Ground cork dust | Particles and fibrillary structures; mostly < 10 μm. | VTT | 5.0 |

[1]Cellulose, with methoxy substitution between 27.5-31.5% (weight). Degree of substitution (DS, average number of substituent groups attached to the ring hydroxyls) is 1.5-1.9.

Example 1—Preparation of Foam Coated Paperboard

Dispersion of Polymers:

Polymer dispersions were prepared according to instructions from manufacturers.

Mixing of HefCel and Polymers:

HefCel and CMC were premixed using a Dispermat high shear mixer at low to medium speed. Methyl cellulose dispersion was added and foaming was performed using the Dispermat high shear mixer at high speed (6000 rpm) for 5 minutes.

Addition of Cork Dispersion:

Where ground cork dust was used it was added to mixture before the premixing with the Dispermat mixer.

Coating:

Foam coatings were prepared by distributing the foam on baseboard with an Erichsen lab coater applicator. The foam coating (Sample 1) was coated on baseboard 1, and the foam coating with cork dust (Sample 2) was coated on baseboard 2. The coated samples were dried in an oven for 10 minutes at 105° C. Before testing, the samples were equilibrated in a room with standard conditions (23° C. and 50% relative humidity).

Details of the coating formulation and of the coat weight, thickness and bulk of the dried foam coatings are provided in Table 2.

TABLE 2

| Coating formulation | | | | | |
|---|---|---|---|---|---|
| Sample | Coating Formulation (pph) | SC, % | Coat weight, g/m$^2$ | Coating thickness, μm | Coating bulk, cm$^3$/g |
| Baseboard 1 (Reference 1) | — | — | — | — | — |
| Baseboard 2 (Reference 2) | — | — | — | — | — |
| Baseboard 1 + Foam (Sample 1) | HefCel/CMC/MeC hiMw 100/2.5/3.4 | 8.4 | 15 | 93 | 6.2 |
| Baseboard 2 + Foam with cork (Sample 2) | HefCel/CMC/MeC loMw/ground cork 100/3.2/6.3/30 | 9.4 | 35.7 | 93 | 2.6 |

Analysis:

Stable foam structures were obtained. The cork dust was well incorporated and the coatings with cork dust had a good touch and feel.

The thermal resistance of baseboard 1 (reference 1), baseboard 2 (reference 2), baseboard 1 with foam coating (Sample 1), and baseboard 2 with foam coating with cork dust (Sample 2), was screened using a preheated plate. A temperature sensor was used to follow the temperature increase through the sample. The results are presented in Table 3 and FIG. 1. The results show a significant increase in thermal resistance with the foam coating, and a further significant increase in thermal resistance with the foam coating with cork dust.

TABLE 3

| Thermal resistance | | | | |
|---|---|---|---|---|
| | Temperature (° C.) | | | |
| Time (s) | Baseboard 1 (Reference 1) | Baseboard 2 (Reference 2) | Baseboard 1 + Foam (Sample 1) | Baseboard 2 + Foam with cork (Sample 2) |
| 10 | 86.0 | 82.4 | 79.7 | 66.5 |
| 15 | 89.0 | 84.2 | 85.7 | 71.5 |
| 20 | 90.0 | 84.9 | 87.0 | 76.9 |
| 25 | 91.0 | 86.1 | 87.2 | 78.1 |
| 30 | 91.0 | 87.2 | 87.2 | 79.4 |
| 60 | 92.0 | 89.4 | 86.9 | 81.5 |

The thermal conductivity of baseboard 2 (reference 2) and baseboard 2 coated with foam with cork (Sample 2) were measured using the Transient Plane Source (TPS) method with a Hot Disk Thermal Constants Analyser (Hot Disk Ltd.). The thermal conductivity of the baseboard 2 (reference 2) was 0.12 W/mK and the thermal conductivity of the baseboard 2 coated with foam with cork (Sample 2) was 0.06 W/mK. Thus, with only a relatively thin coating layer (compared to the thickness of the baseboard), the thermal conductivity of the material can be reduced by about 50%.

Figure 2:
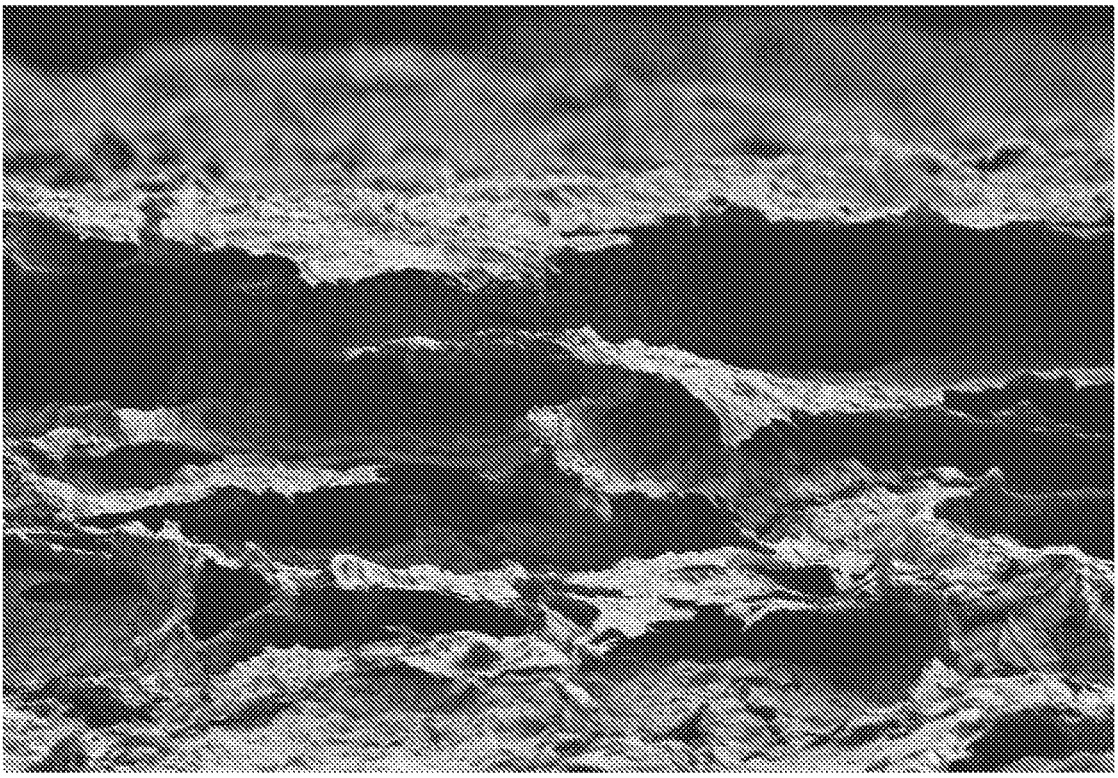
FIG. 2 is a 500× scanning electron microscope (SEM) image of a cross-cut of a foam coating with cork dust.

The porous structure of the foam coating was shown by scanning electron microscope (SEM). FIG. 2 is a 500× image of a cross-cut of a foam coating with cork dust. For the SEM imaging, a strip of the coated board was immersed into liquid nitrogen and bent broken. The sample was attached to an Al-stub with double-sided carbon tape. The sample was sputter coated with ~4 nm of Au—Pd and imaged in secondary electron mode in SEM (Zeiss Merlin). The acceleration voltage was 2 kV and beam current 60 pA.

The invention claimed is:

1. A coated paper or paperboard comprising:

a paper or paperboard substrate, and a solid closed cell foam coating layer disposed on a surface of said paper or paperboard substrate, wherein said solid closed cell foam coating layer comprises:

60-99.5 wt % of a nanocellulose based on a total dry weight of the closed cell foam, 0.1-10 wt % of a polymeric foaming agent based on the total dry weight of the closed cell foam, 0.1-20 wt % of a polymeric dispersing agent, or a polymeric rheology modifying agent, or both based on the total dry weight of the closed cell foam, wherein the solid closed cell foam comprises closed cells trapped inside a matrix formed of the nanocellulose, the polymeric foaming agent, the polymeric dispersing agent, the polymeric rheology modifying agent, and optional other additives.

2. The coated paper or paperboard according to claim 1, wherein the nanocellulose is unmodified nanocellulose or modified nanocellulose, or a mixture thereof.

3. The coated paper or paperboard according to claim 1, wherein the polymeric foaming agent is selected from a group consisting of: polysaccharide ethers, starch, hemicellulose, polyvinyl alcohol, and mixtures thereof.

4. The coated paper or paperboard according to claim 1, wherein the polymeric foaming agent is selected from a group consisting of: methyl cellulose (MC), ethyl cellulose (EC), hydroxyethyl cellulose (HEC), hydroxypropyl cellulose (HPC), methylethyl cellulose (MEC), hydroxyethylmethyl cellulose (HEMC), hydroxypropylmethyl cellulose (HPMC), ethylhydroxyethyl cellulose, carboxymethylhydroxyethyl cellulose, and mixtures thereof.

5. The coated paper or paperboard according to claim 1, wherein the polymeric foaming agent is methyl cellulose.

6. The coated paper or paperboard according to claim 5, wherein the methyl cellulose has an average degree of substitution in a range of 1.0-2.5.

7. The coated paper or paperboard according to claim 1, wherein the polymeric foaming agent has a viscosity in aqueous solution at 2 wt % concentration between 10 and 10,000 cPs.

8. The coated paper or paperboard according to claim 1, wherein said polymeric dispersing agent, said polymeric rheology modifying agent, or said combination thereof is a carboxymethyl cellulose (CMC).

9. The coated paper or paperboard according to claim 1, wherein an average diameter of the closed cells in the closed cell foam coating layer is in a range of 5-300 μm.

10. The coated paper or paperboard according to claim 1, further comprising a particulate material dispersed in the closed cell foam coating layer.

11. The coated paper or paperboard according to claim 10, wherein the particulate material is cork particles.

12. The coated paper or paperboard according to claim 10, wherein the particulate material has an average particle diameter in a range of 0.1-1000 μm.

13. The coated paper or paperboard according to claim 10, wherein the closed cell foam of the closed cell foam coating layer comprises in a range of 1-50 wt % of the particulate material, based on a total dry weight of the closed cell foam.

14. The coated paper or paperboard according to claim 1, wherein a basis weight of the closed cell foam coating layer is in a range of 10-50 gsm.

15. The coated paper or paperboard according to claim 1, wherein a basis weight of the paper or paperboard substrate is in a range of 60-500 gsm.

16. The coated paper or paperboard according to claim 1, wherein the coated paper or paperboard has a thermal conductivity below 0.1 W/mK.

17. A carton blank comprising a coated paper or paperboard according to claim 1.

18. A food container comprising a coated paper or paperboard according to claim 1.

* * * * *